United States Patent [19]

Balod

[11] 4,157,721

[45] Jun. 12, 1979

[54] CIGARETTE PIPE HAVING A TAR CARTRIDGE

[76] Inventor: Marcelo M. Balod, 129-14th Ave., Cubao, Quezon City, Philippines

[21] Appl. No.: 743,756

[22] Filed: Nov. 22, 1976

[51] Int. Cl.[2] ..... A24F 13/02; A24F 1/04

[52] U.S. Cl. ..... 131/187; 131/210; 131/212 A

[58] Field of Search ..... 131/187, 211, 212, 213, 131/218, 198 R, 210, 10.5, 212 A

[56] References Cited

U.S. PATENT DOCUMENTS

| | | | |
|---|---|---|---|
| 2,126,422 | 8/1938 | Tarrant | 131/212 A X |
| 3,366,123 | 1/1968 | Brothers | 131/210 X |
| 3,690,329 | 9/1972 | Lin | 131/210 X |
| 3,840,029 | 10/1974 | Streule et al. | 131/187 |
| 3,877,470 | 4/1975 | Jewett et al. | 131/212 A X |
| 4,038,994 | 8/1977 | Aikman | 131/187 |

*Primary Examiner*—Stephen C. Pellegrino

[57] ABSTRACT

A cigarette pipe is disclosed incorporating therewith a replaceable tar cartridge which acts as a liquefier tube. Said tar cartridge is snugly fitted at the downstream portion of the cigarette holder of said pipe. A smoke passage inlet and smoke passage outlets passing to and from said cartridge are tiny orifices of predetermined diameter to produce a low pressure chamber therein. During smoking, a suction pressure is applied at the mouthpiece end and the hot gas molecules of the stream of smoke, through an inlet orifice, flows at high velocity inside the tar cartridge which provides the low pressure chamber and wherein the highly accelerated stream of smoke is expanded, cooled and liquefied. The liquefied tar particles suspended in the stream of smoke sticks and accumulates to the inner walls of the cartridge.

1 Claim, 7 Drawing Figures

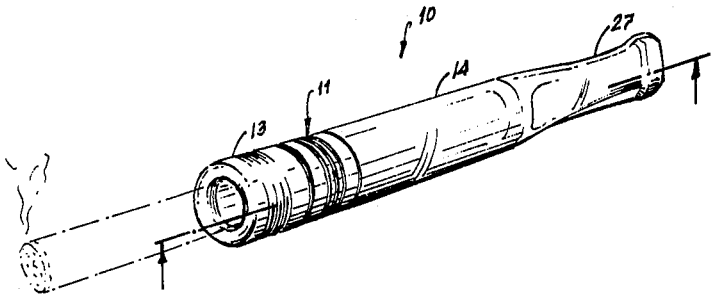
Fig. 1.
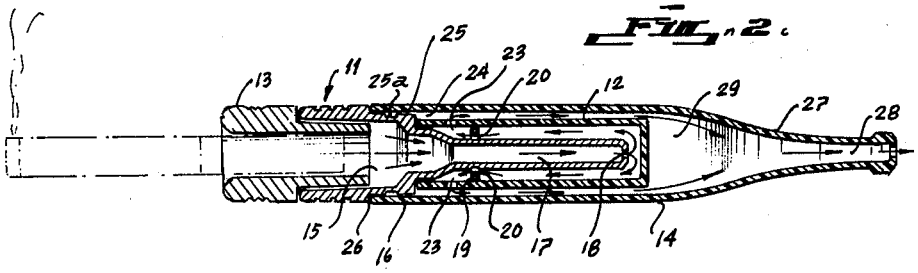
Fig. 2.
Fig. 3.
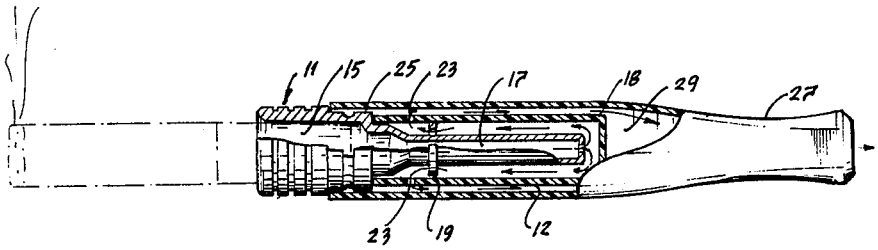

CIGARETTE PIPE HAVING A TAR CARTRIDGE

The present invention relates in general to cigarette pipes, and more particularly, to a cigarette pipe having a tar cartridge which is detachably secured therewith.

Conventional cigarette pipes equipped with tar collecting means are provided with a very thin hole wherein smoke is coursed to pass therethrough and impinge onto a solid surface at high velocity so that tar particles adhere to the solid surface. In another method, tar is collected by providing layers of fibers positioned in the path of smoke so that tar particles adhere to said fibers. Others combine the impinging method and the use of fibers to collect or separate tar particles from the smoke.

However, there are disadvantages which are inherent in the aforementioned methods. As for example, in the method of having the smoke impinge onto a solid surface at high velocity so that tar particles adhere to said surface, the adherence of the tar could not be fully attained since the surface area on which the tar particles adhere is insufficient thereby allowing the possibility of some of the accumulated tar to be inhaled by the smoker. In the use of layers of fibers, the spaces defined there-between are easily clogged thereby rendering the inhalation very hard. As such, frequent change of the filter becomes necessary. In the combination of the first and the second method, it would be too expensive, complicated and intricate to clean or change the tar collecting means.

SUMMARY OF THE INVENTION

This invention is a type of cigarette pipe with a different process of removing tar particles from cigarette smoke. As is well known, when a tobacco leaf is burned, it undergoes the process of distillation like that in a plant or wood. When heated, the volatile substances found in the crushed leaf are separated in the form of gaseous molecules which readily mix with air. These gaseous molecules are carried by the stream of smoke inside a tar cartridge which acts as liquefier. Hence, this process of partially removing tar and nicotine evolves around the principle of liquefaction of gas and kinitic theory of gas.

Based on these principles, it is, therefore, a principal object of the present invention to provide a cigarette pipe wherein the stream of smoke is subjected to flow at high velocity and to incorporate therewith a tar cartridge to provide a low pressure area such that the highly accelerated smoke is expanded, cooled and liquefied therein whereby the tar particles suspended in the stream of smoke liquefies and sticks to the inner walls of the cartridge.

A further object of this invention is to provide a cigarette pipe with a tar cartridge wherein said cartridge could be easily replaced with a new one, the replaced tar-filled cartridge being provided with a cap such that it could be kept and cleaned at any time availabe by the user.

A still further object of this invention is to provide a cigarette pipe having a tar cartridge, the volume of which is sufficiently large enough for long use and the construction of which minimizes the leakage of tar therefrom, when in use.

Other objects are simplicity in its construction, cheap in its manufacture and efficiency in its performance.

BRIEF DESCRIPTION OF THE DRAWINGS

FIG. 1 is a perspective view of a preferred embodiment of this invention disclosing a cigarette pipe having a tar cartridge with a cigarette adapter;

FIG. 2 is a cross-sectional view taken along line 2—2 of FIG. 1;

FIG. 3 is a cross-sectional view similar to FIG. 2 but without a cigarette adapter;

DETAILED DESCRIPTION OF A PREFERRED EMBODIMENT

Figure 4C:
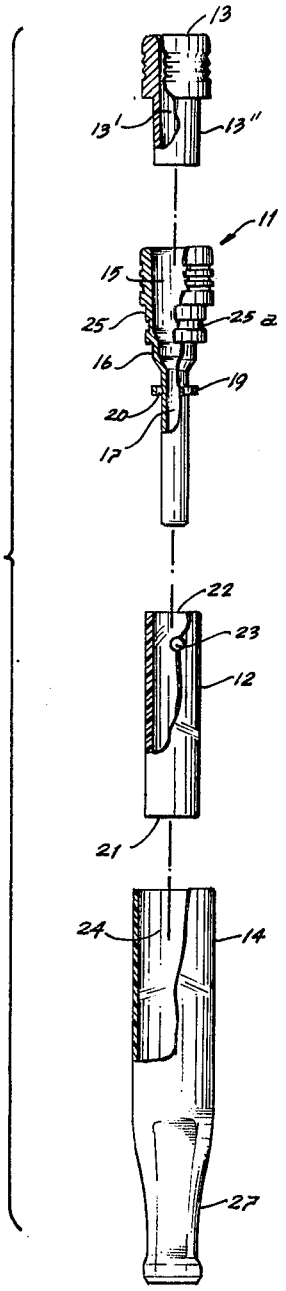
FIG. 4 is an exploded view of FIG. 1.

Referring now to the drawings in detail, there is shown in FIGS. 1, 2 and 4, a cigarette pipe having a tar cartridge generally indicated as 10 comprising an elongated cigarette holder 11 to receive therein a standard diameter cigarette; a tar cartridge 12 adapted to be inserted at the downstream portion of said cigarette holder; a cigarette adapter 13 adapted to receive smaller diameter cigarettes and insertable in said holder 11; and a cigarette pipe body member 14 wherein said cigarette holder 11 with a cartridge is inserted in a press-fitted engagement therein.

In FIG. 3, the cigarette pipe as shown therein is identical to that of FIGS. 1 and 2, except that the cigarette adapter 13 which is used on smaller diameter cigarettes is removed and the cigarette holder 11 which is used on standard diameter cigarettes is illustrated.

As shown in FIGS. 1 and 2, said elongated cigarette holder 11 comprises an axial bore defined by a cigarette receiving bore 15 adapted to receive therein standard diameter cigarettes, the rear end of which is tapered and joined to a short bore 16 of reduced diameter which in turn is in communication with an extension bore 17 having a diameter much less than said bore 16 and terminating at an orifice 18. An annular plate 19 is integrally formed as a one-piece structure on said extension bore 17". The omission of said sentenve was inadvertently made. Provided on said annular plate are diametrically opposed drilled holes 20 to serve as smoke passageways.

Insertably secured on the outer surface of the short bore 16 and the annular plate 19 is the plastic tar cartridge 12 defined by a closed bottom end wall 21 and an open top end 22. Proximate its open end above said annular plate 19 is provided with smoke outlet openings 23. It is herein shown that the space in the tar cartridge bounded by the smoke inlet orifice 18 of the extension bore 17 and the drilled holes 20 of the annular plate 19 define a low pressure chamber wherein the tar is expanded, cooled and liquefied.

The cigarette pipe body member 14 is formed on one end thereof with a mounting bore 24, the diameter of which permits a press-fit engagement with the reduced cylindrical portion 25 of said cigarette holder 11 and the end of which rests on the shoulders 26 to form a flush relationship with each other. Provided on said reduced portion 25 is an annular groove 25*a*. The other end of said body member 14 is tapered and shaped to provide a mouthpiece 27 of conventional configuration and having an opening 28.

The cartridge 12 and the mounting bore 24 of the cigarette pipe define therein an annular chamber 29 to allow passage of the smoke from the cartridge via the holes 20, then to the opening 23 and exits the opening 28 of the mouthpiece, as shown by arrows.

With this construction, it is shown that the tobacco smoke generated in a cigarette due to suction applied at the mouthpiece 27 is led through the short bore 16, the diameter of which is smaller than the diameter of the cigarette receiving bore 15 and then to a much reduced bore 17 and ultimately, to an orifice 18. Comparatively, the diameters are abruptly reduced to such an extent that a relatively high velocity of smoke is produced at the orifice 18. After the orifice, a low pressure area is necessary by providing a tar cartridge 12 such that expansion of the high velocity smoke streams results to cooling and liquefaction of the tar particles suspended in said smoke streams. The tar particles which is dark, browny oily substance sticks to the walls of the cartridge and the nicotine which is an oily transparent liquid settles at the bottom. The escaping smoke are further cooled at the annular chamber 29.

Figure 6:
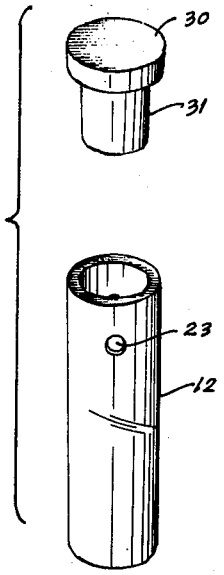
FIG. 6 is an exploded perspective view showing a tar cartridge provided with a cap for use when said tar cartridge is already filled with tar.
Figure 7:
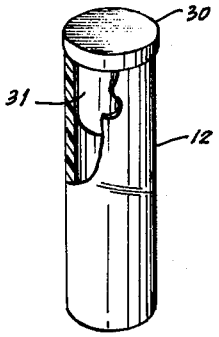
FIG. 7 is a perspective view with a cut-away portion showing the cap in its closed position to the cartridge.

As clearly shown in FIGS. 6 and 7, the cartridge 12 is provided with a spare end cap 30 having a reduced portion 31 and adapted to be in press-fit engagement thereon. The length of the reduce portion 31 is so designed to cover the outlet openings 23 of said cartridge 12 to prevent the leakage of the tar and nicotine entrapped therein. The end cap 30 is used only for a replaced tar-filled cartridge which will later on be cleaned for the next use.

The tar cartridge with an estimated volume of about 320 cubic millimeters can accumulate tar particles and nicotine of about twelve to twenty king size filter cigarettes.

In FIGS. 2 and 4, the cigarette adapter 13 is defined by a small diameter cigarette receiving bore 13' and a reduced portion 13'' adapted to snugly fit into the standard diameter cigarette receiving bore 15 of the cigarette holder 11.

Figure 5:
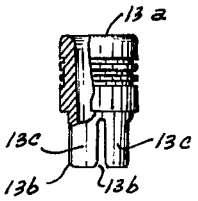
FIG. 5 is a side view of a modified cigarette adapter with a cut-away portion.

In FIG. 5, there is shown a modified cigarette adapter **13*a* which differs only from the adapter 13 of FIG. 2 by the provision of slots 13*b* on the reduced portion resulting to a segmented attachment to the standard diameter cigarette receiving bore 15 of the holder 11. With this construction, adjustment could be easily done for a snug fit engagement therein by slightly expanding the segments 13*c***.

While a preferred embodiment of this invention has been illustrated and described, it should be understood by those skilled in the art t that many changes and modifications may be resorted to without departing from the spirit and scope of the invention.

I claim:

1. A cigarette pipe having a tar cartridge comprising, (a) a hollow body member defined by a mounting bore at one end and a mouthpiece at the other end;

(b) an elongated cigarette holder mounted in a press-fit engagement in said mounting bore, said holder being defined by a cigarette the rear end of which is tapered and joined to a short bore which in turn is in communication with receiving bore, an extension bore of reduced diameter contiguous to and in axial alignment with said receiving bore and terminating at a smoke outlet orifice;

(c) an annular plate integrally formed as a one-piece structure on said extension bore disposed proximate the upstream portion thereof said annular plate having diametrically disposed smoke outlet orifices passing therethrough; and (d) a tar cartridge defined by a closed bottom wall and an open top end to snugly fit on said cigarette holder and said annular plate whereby encompassing said extension bore, said cartridge defining therein a low pressure chamber whereby the high velocity stream of smoke is expanded, cooled and liquefied and said cartridge having smoke outlet openings disposed proximate its open end above said annular plate and communicating to the mouthpiece end through an annular chamber defined between said hollow body member and said cartridge.

* * * * *